US005743117A

United States Patent [19]

Woo et al.

[11] Patent Number: 5,743,117

[45] Date of Patent: *Apr. 28, 1998

[54] QUICK RELEASE HANDCUFF HAVING OVERRIDING MEANS FOR ENABLING DUAL USE AS A TRAINING AND A RESTRAINING DEVICE

[76] Inventors: Lansing S. Woo, 143 S. Saltair Ave., Los Angeles, Calif. 90049; Ronnie J. Frigulti, 955 Thistlegate Rd., Agoura Hills, Calif. 91301

[ * ] Notice: The term of this patent shall not extend beyond the expiration date of Pat. No. 5,463,884.

[21] Appl. No.: 510,107

[22] Filed: Aug. 1, 1995

Related U.S. Application Data

[63] Continuation-in-part of Ser. No. 276,093, Jul. 15, 1994, Pat. No. 5,463,884.

[51] Int. Cl.[6] ..... E05B 75/00

[52] U.S. Cl. ..... 70/16

[58] Field of Search ..... 70/14–18

[56] References Cited

U.S. PATENT DOCUMENTS

| | | | |
|---|---|---|---|
| 268,171 | 11/1882 | Bean | 70/16 |
| 628,139 | 7/1899 | Cumming | 70/16 |
| 647,735 | 4/1900 | Widmayer | 70/16 |
| 766,263 | 8/1904 | Judd | 70/16 |
| 1,499,960 | 7/1924 | Almedia . | |
| 1,806,163 | 5/1931 | Hoglund | 70/16 |
| 1,872,857 | 8/1932 | Wesson et al. | 70/16 |
| 2,390,885 | 12/1945 | Kelley | 70/16 |
| 2,759,349 | 8/1956 | McKee | 70/16 |
| 3,423,871 | 1/1969 | Foley . | |
| 4,162,622 | 7/1979 | Daleo | 70/16 |
| 4,300,368 | 11/1981 | Sullivan | 70/16 |
| 4,314,466 | 2/1982 | Harris | 70/16 |
| 4,509,346 | 4/1985 | Szczepanek | 70/16 |
| 4,574,600 | 3/1986 | Moffett | 70/16 |
| 4,694,666 | 9/1987 | Bellingham et al. | 70/16 |
| 4,697,441 | 10/1987 | Allen | 70/16 |

*Primary Examiner*—Suzanne Dino

*Attorney, Agent, or Firm*—Blakely, Sokoloff, Taylor & Zafman

[57] ABSTRACT

A handcuff for dual use as a quick-release training device and an actual restraint device, which has a bail and an arcuate ratchet member with teeth. The handcuff includes a locking assembly, disposed within a bail, that has a pawl having a first end pivotally coupled to the bail and a second end with teeth pivotal between a secured position in which the teeth of the pawl engage the teeth of the ratchet member and an unsecured position in which the second end of the pawl is separated from the ratchet member. The second end of the pawl further has a vertical shoulder for engagement with the flange of a key inserted within the locking assembly for manipulating the pawl between the secured and unsecured positions upon rotation of the key. A stop member is disposed above the pawl and movable in and out of contact with the pawl upon engagement with the key to prevent the pawl from being placed in the unsecured position when the stop member is in contact with the pawl. A first shaft and knob is included to provide a quick-release feature for placing the pawl in the unsecured position when the stop member is not in contact with the pawl. A second shaft and knob is included to provide a simple way to quickly engage and disengage the stop member.

16 Claims, 6 Drawing Sheets

QUICK RELEASE HANDCUFF HAVING OVERRIDING MEANS FOR ENABLING DUAL USE AS A TRAINING AND A RESTRAINING DEVICE

BACKGROUND OF THE INVENTION

Related U.S. Application Data

This application is a continuation-in-part of patent application Ser. No. 08/276,093 filed on Jul. 15, 1994 now U.S. Pat. No. 5,463,884 for a "QUICK RELEASE HANDCUFF HAVING OVERRIDING MEANS FOR ENABLING DUAL USE AS A TRAINING AND A RESTRAINING DEVICE" by Lansing S. Woo and Ronnie J. Frigulti, allowed on Apr. 3, 1995.

1. Field of the Invention

The present invention is related to the field of personal restraining devices, and more specifically to handcuffs of the kind normally used by police officers in the line of duty.

2. Description of Related Art

It is well-known among police professionals, and readily supported by documented statistics, that one of the most dangerous and vulnerable tasks performed by law enforcement officers is the procedure of handcuffing a suspect.

However, today's police officers receive far too little practice in proper handcuffing techniques. Proficiency in handcuffing techniques requires regular and consistent practice, and absent regular practice, proficiency is quickly lost, as is personal confidence in one's tactical handcuffing ability.

Most law enforcement officers are required to regularly practice and qualify with their service weapons, but very few are required to regularly review and practice proper handcuffing techniques to the extent necessary to develop lasting competence and proficiency. Perhaps the biggest factor discouraging regular practice is the difficulty in removing the handcuffs once they are secured. This is because of the dexterity required in manipulating the key to unlock the handcuffs. Placing handcuffs on a suspect (or a training partner) is rather straight forward as the procedure is facilitated by use of the usual pawl and ratchet mechanism which permits the handcuffs to be "slapped on" the suspect's wrists without use of a key. Yet, when the handcuffs are to be removed, the officer must hold the suspect's arm in place, insert the key in a handcuff with the proper alignment to the keyhole, rotate the key to lift the spring-biased pawl from the ratchet and manipulate the handcuff to open the bail. Furthermore, when handcuffs having double locking mechanisms (e.g., U.S. Pat. No. 4,574,600 issued to Moffet) are employed for added safety in preventing the suspect from picking the lock of the handcuff, an additional step is required to first rotate the key in a non-opening direction in order to unlock the double locking mechanism.

In training, the problem arises that too much time is wasted in removing the handcuffs through use of a key rather than practicing proper application techniques. During a typical handcuff training session, approximately two-thirds to three-fourths of the training session is spent by students in removing handcuffs, leaving too little time to practice other handcuffing techniques. Often times, students are told by instructors to simulate the actual handcuffing process in order to conserve training time. Another disadvantage is that with such delays in actual practice and the use of simulated techniques, students quickly become bored with the training, and thus, do not readily develop the skills needed for safely handcuffing a suspect.

In the prior art, toy handcuffs, such as those described in U.S. Pat. Nos. 1,806,163 and 3,423,871 issued to T. J. Hoglund and C. F. Foley, respectively, have been designed with a quick release mechanism to facilitate opening of the handcuffs by children. However, these handcuffs are designed for use solely as toys as they can be easily opened by the wearer without the use of a key. Although such handcuffs could conceivably be adapted for training purposes, they would not be readily accepted for such use by the police force since they do not comprise the same design and functionality as those actually used in the field. An officer who practices with a different type of handcuff during training would not posses sufficient skill and confidence in using the actual handcuffs on the street. Furthermore, it would also be difficult to justify the expense to municipal and state police departments for separate sets of training handcuffs since they could only be used for training purposes.

Accordingly, it would be advantageous to provide a handcuff of the type normally used by police officers having a quick-release mechanism for training purposes and means for overriding the quick-release mechanism so that the training handcuff can be converted to a restraining device for actual use.

Another goal of handcuff training is to develop a habit in the students to always engage a double locking feature of the handcuff after the handcuff is secured on the suspect. Because currently, a student is required to use the end of a handcuff key or other object to engage this double locking mechanism during training, students often forget to engage the double locking mechanism entirely.

Accordingly, it would be advantageous to provide a handcuff of the type normally used by police officers having means for quickly engaging/disengaging the double-lock mechanism for training purposes and a way to remove these means so that the training handcuff can be converted to a restraining device for actual use.

SUMMARY OF THE INVENTION

It is therefore an object of the present invention to provide a quick-release handcuff having overriding means for enabling dual use as a training and a restraining device.

It is another object of the present invention to provide a handcuff having quick-release buttons mounted on opposite sides of the bail of the handcuff, with the buttons being coupled to the pawl of the locking assembly via a quick-release shaft for disengaging the pawl from the ratchet and unlocking the handcuff upon movement of the buttons.

It is yet another object of the present invention to provide a quick-release handcuff as described above having a double locking mechanism for securing the pawl to the ratchet and preventing the handcuff from being unlocked with the quick-release buttons to enable use of the handcuff as an actual restraining device.

It is a further object of the present invention to provide a handcuff having a double locking mechanism in addition to a quick-release shaft for unlocking both the double locking mechanism upon rotation of the shaft and the handcuffs upon one of rotation and translation of the shaft, with the quick-release shaft being detachable from its coupling to the pawl to convert the handcuff into an actual restraining device.

It is a further object of the present invention to provide a handcuff having a double locking shaft coupled to the double locking mechanism in addition to a quick release shaft for unlocking the handcuff. The double locking shaft engages and disengages the double locking mechanism and is detachable from its coupling to the double locking mechanism to convert the handcuff into an actual restraining device.

These and other objectives of the present invention are accomplished by providing a handcuff having side-mounted, quick-release buttons which allow the handcuff to be manually unlocked and removed without use of a key. The invention is primarily for use in training as it significantly reduces the time required to unlock and remove handcuffs during training sessions. However, the invention further provides a double locking mechanism which not only locks the pawl to the ratchet, but also locks the quick-release buttons in place so that the handcuff may be used as an actual restraining device by police officers in the field.

Furthermore, in an alternate embodiment of the present invention, a training type handcuff is provided with a double locking mechanism which can also be unlocked via the quick-release buttons to provide quicker and better training in the operation of the double locking feature when the handcuff is applied to a trainee's wrists. Nonetheless, this training type handcuff may be converted into an actual restraining device by detachment of the quick-release buttons and shaft from the handcuff such that a suspect cannot unlock the handcuff.

Moreover, in a preferred embodiment of the present invention, a training type handcuff is provided with a double locking mechanism which is engaged and disengaged by movement of a double locking shaft and button, which are coupled to the double locking mechanism. This double locking shaft greatly simplifies the engaging/disengaging of the double locking mechanism and thus, helps to develop a habit in students of always engaging the double locking mechanism after the handcuff is secured on a suspect. The handcuff is also provided with quick-release buttons, coupled to the quick-release shaft, for unlocking the handcuffs upon translation of the shaft.

BRIEF DESCRIPTION OF THE DRAWINGS

The objects, features and advantages of the present invention will be apparent from the following detailed description in which.

DETAILED DESCRIPTION OF THE INVENTION

The present invention provides a quick-release handcuff having overriding means for enabling dual use as a training device and a restraining device. In the following description, for purposes of explanation and not limitation, specific details are set forth, such as preferred structures and elements, particular dimensions, specific techniques, etc. in order to provide a thorough understanding of the present invention. However, it will be apparent to one skilled in the art that the present invention may be practiced in other embodiments and without all the specific details set forth. In other instances, well known features and uses are not set forth in detail in order to avoid unnecessarily obscuring the present invention.

Figure 1A:
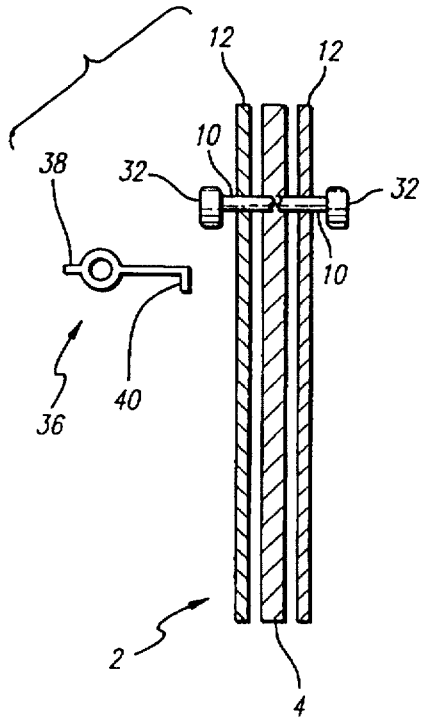
FIG. 1(A) is a simplified end view of the handcuff showing the parallel side plates of the bail having two quick-release shafts and knobs attached thereto, the ratchet member disposed between the side plates and a key used to lock and unlock the handcuff.
Figure 1B:
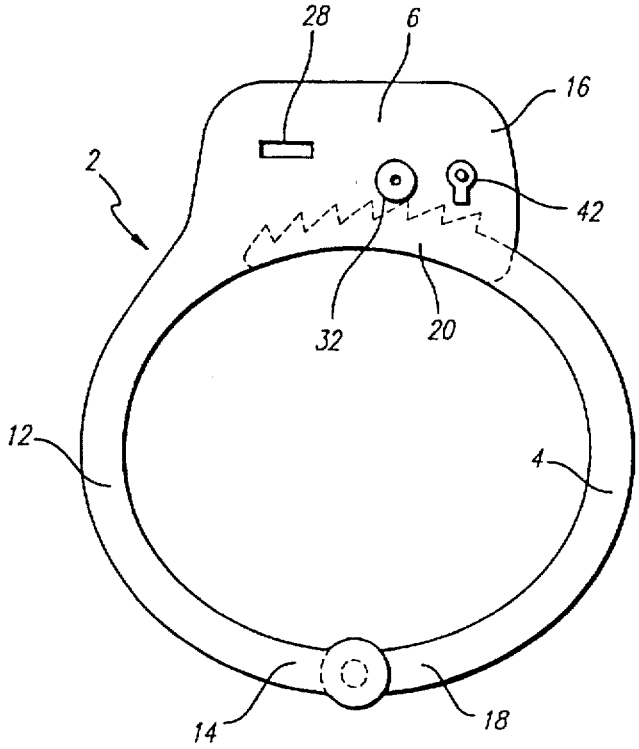
FIG. 1(B) is a side view of the handcuff of the present invention showing the ratchet member secured within the bail in addition to the surface of a side plate of the bail depicting thereon a keyhole, the knob of the quick-release shaft and a horizontal slot for manipulating the double locking mechanism.

As shown in FIGS. 1(A) and 1(B), the quick-release handcuff of the present invention comprises a bail 2 having parallel side plates 12 extending between first and second ends 14, 16 of the bail 2 and an arcuate ratchet member 4 having a proximate end 18 pivotally coupled to the first end 14 of the bail 2 to enable passage of a distal end 20 of the ratchet member 4 between the parallel side plates 12. At the second end 16 of the bail 2, an enclosed locking assembly 6 is provided within the side plates 12 of the bail 2. As shown in each of the FIGS. 2–4, the locking assembly 6 generally comprises a pawl 8 having a first end 22 pivotally coupled to the bail 2 and a second end 24 adapted with teeth for engagement with the teeth of the ratchet member 4. The second end 24 of the pawl 8 is pivotal between a secured position where the teeth of the pawl 8 are engaged with the teeth of the ratchet member 4 and an unsecured position where the pawl 8 is entirely disengaged from the ratchet member 4. The second end 24 of the pawl 8 is biased into engagement with the ratchet member 4 by means of a spring member 34 applied to an upper surface of the pawl 8.

In placing the handcuff on the wrist of a suspect, the distal end 20 of the ratchet member 4 is pivoted in a counter-clockwise direction around the forearm and inserted into the locking assembly 6 where the teeth of the pawl 8 and ratchet member 4 engage to secure the ratchet member 4 within the bail 2. To unlock the handcuff without use of the quick-release, the pawl 8 is disengaged from the ratchet member 4 by means of a key 36 being inserted through a keyhole 42 formed in a side plate 12 of the bail 2. At a distal end 20 of the key 36, a flange 40 is provided for engaging a vertical shoulder 26 formed at the second end 24 of the pawl 8 upon a clockwise rotation of the key 36. The flange 40 of the key 36 lifts the vertical shoulder 26 upward to lift the pawl 8 out of the teeth of the ratchet member 4 against the biasing force of the spring member 34.

Figure 2A:
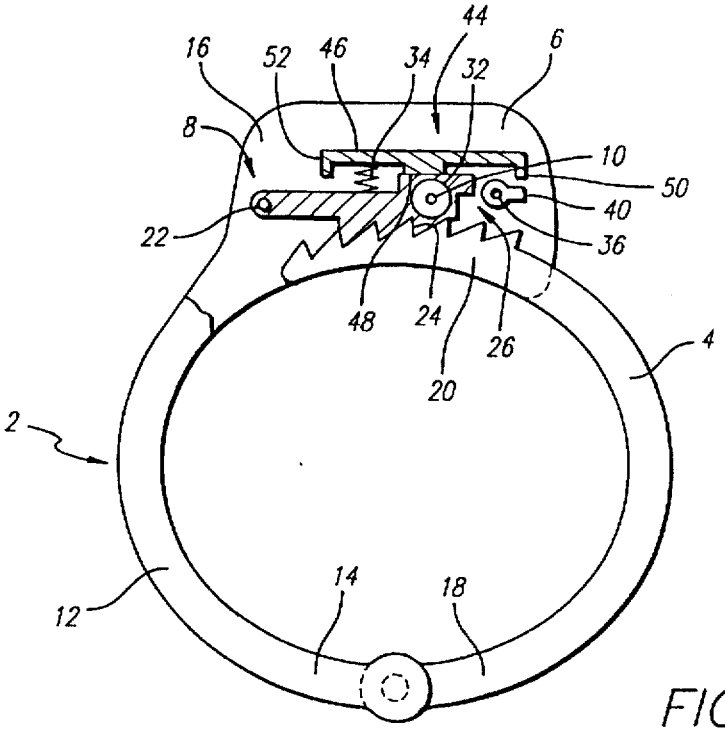
FIG. 2(A) is a side view of an embodiment of the handcuff showing the pawl in the secured position and the double locking mechanism situated in the engaged position.

To convert the above-described handcuff into a training device, the present invention provides a quick-release mechanism comprising a shaft 10 attached to a side face of the pawl 8 at its second end 24, preferably in a generally perpendicular orientation to the side face. As shown in FIGS. 1(A) and 2(A), the distal end 20 of the shaft 10 protrudes through a vertical slot (not shown) formed in a respective side plate 12 of the bail 2 and has attached thereto a circular knob 32 having a diameter larger than the length of the slot. With this modification, a trainee can disengage the pawl 8 from the ratchet member 4 without use of a key 36 by translation of the knob 32 and shaft 10 upwards along the slot. In a preferred embodiment (shown in FIG. 1(A)), a second shaft 10 is further attached to an opposite side face of the pawl 8 and comprises a distal end protruding through a second slot formed in the side plate 12 with a knob 32 attached thereto. By use of this embodiment, a trainee can quickly unlock the handcuff by manipulating either of the knobs 32 regardless of the orientation of the handcuff when placed on the forearms of another trainee.

With the implementation of a quick-release mechanism, the handcuff of the present invention is well suited for practicing handcuffing techniques since it retains the functionality and design features of conventional handcuffs but enables the handcuff to be removed by one simple movement of the fingers.

Thus, one of the most dangerous parts of apprehending a suspect—that is, handcuffing the suspect—can now be repeatedly practiced numerous times in a short duration to ensure that each police officer has the required proficiency.

However, in order to render the handcuff cost effective and more versatile, the present invention further provides a quick-release handcuff designed for use in both training and actual use on the street. This is accomplished by providing a double locking mechanism in the form of a stop member 44 disposed above the pawl 8 as shown in FIGS. 2–4. As shown in FIGS. 2–3, the stop member 44 may take the form of a simple, elongated bar 46, yet in an alternative embodiment, the stop member 44 forms an extended portion of the spring member 34 used to bias the pawl 8 against the ratchet member 4 as shown in FIGS. 4(A), 4(B), 4(C) and 5.

The stop member 44 comprises a downward extending shoulder portion 48 preferably disposed proximate to the center of the stop member 44 and proximate to a recess formed in the upper surface of the second end 24 of the pawl 8. The stop member 44 further comprises first and second downward extending flanges 50, 52 disposed on respective ends of the stop member 44, with the first flange 50 being located proximate to the second end 24 of the pawl 8 and the flange 40 of the key 36 when inserted. In a preferred embodiment, the stop member 44 is movable in a generally horizontal direction (or parallel to the pawl 8) by application of a force to either flange 40 to move the shoulder portion 48 in and out of contact with the upper surface of the pawl 8. When in contact with the pawl 8, the stop member 44 acts to maintain the engagement between the pawl 8 and ratchet member 4 despite movement of the quick-release shaft 10 or rotation of the key 36.

Figure 2B:
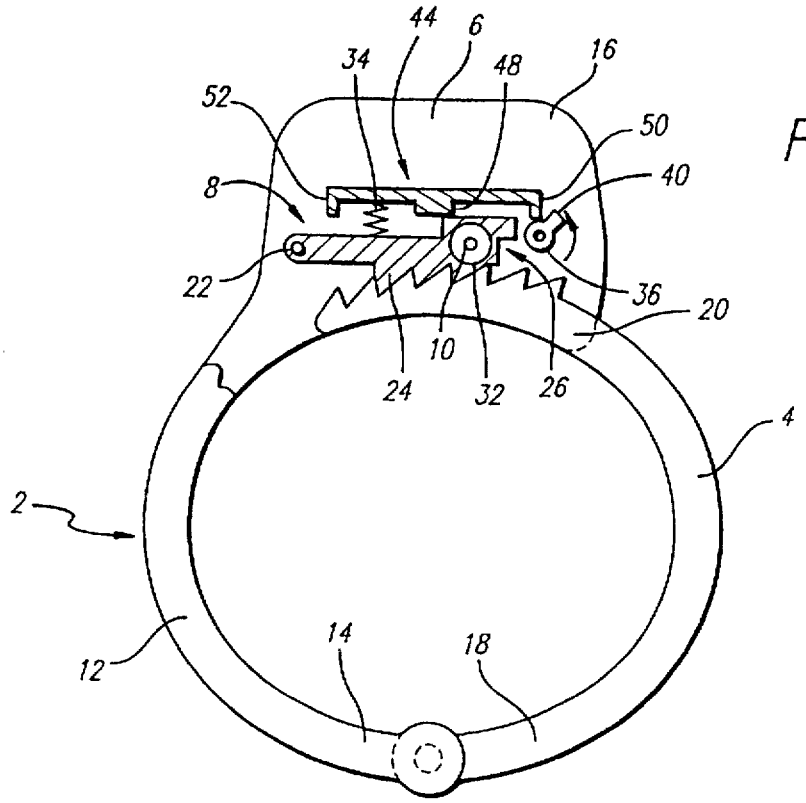
FIG. 2(B) is a side view of an embodiment of the handcuff showing the pawl in the secured position and the double locking mechanism situated in the disengaged position.
Figure 2C:
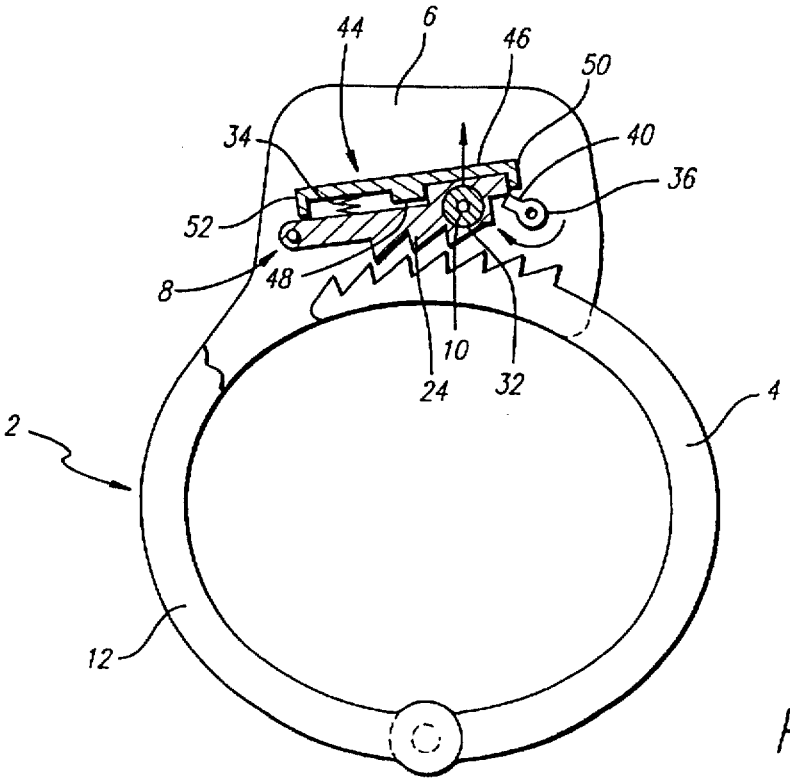
FIG. 2(C) is a side view of an embodiment of the handcuff showing the pawl in the unsecured position and the double locking mechanism situated in the disengaged position.

In an alternate embodiment, shown in FIGS. 2(A), 2(B) and 2(C), the double locking mechanism is engaged by translation of the stop member 44 from left to right to move the shoulder portion 48 from above the recess of the pawl 8 to a contactual position with the upper surface of the pawl 8. The mechanism is then disengaged by movement of the stop member 44 in the opposite direction. With reference to FIGS. 1(A) and 2(A), the mechanism is preferably engaged by inserting and moving the butt 38 of the key 36 within a horizontal slot formed in a side plate 12 of the bail 2 in engagement with the second flange 52 of the stop member 44. The mechanism is preferably disengaged by rotating the flange 40 of the key 36 within the locking assembly 6 in a counter-clockwise direction in engagement with the first flange 50 of the stop member 44. Nonetheless, it should be apparent that other means for moving the stop member 44 may be devised, for example, by inserting the butt 38 of the key 36 within a slot 28 formed in a side plate 12 (or between side plates 12) to the right of the first flange 50 to move the stop member 44 out of contact with the pawl 8, and by rotating the key 36 in a clockwise direction to engage the first flange 50 and move the stop member 44 into contact with the pawl 8.

With this construction, the quick-release handcuff is now suitable for actual use by police officers in the field. When a suspect is apprehended, the handcuff is secured to the suspect's forearm by inserting the ratchet member 4 into the bail 2 and using the butt 38 of the key 36 to engage the second flange 52 of the stop member 44 and move the stop member 44 into contact with the pawl 8 (FIG. 2(A)). In this double locked position, the suspect is prevented from unlocking the handcuff through movement of the knob 32 of the quick-release shaft 10 since it can only be moved after the double locking mechanism has been disengaged by insertion and rotation of the key 36 in a counter-clockwise direction (FIG. 2(B)). The handcuff may then be unlocked either by rotation of the key 36 in the clockwise direction or simply by pulling up on the knob 32 of the quick-release shaft 10 (FIG. 2(C)).

Figure 3A:
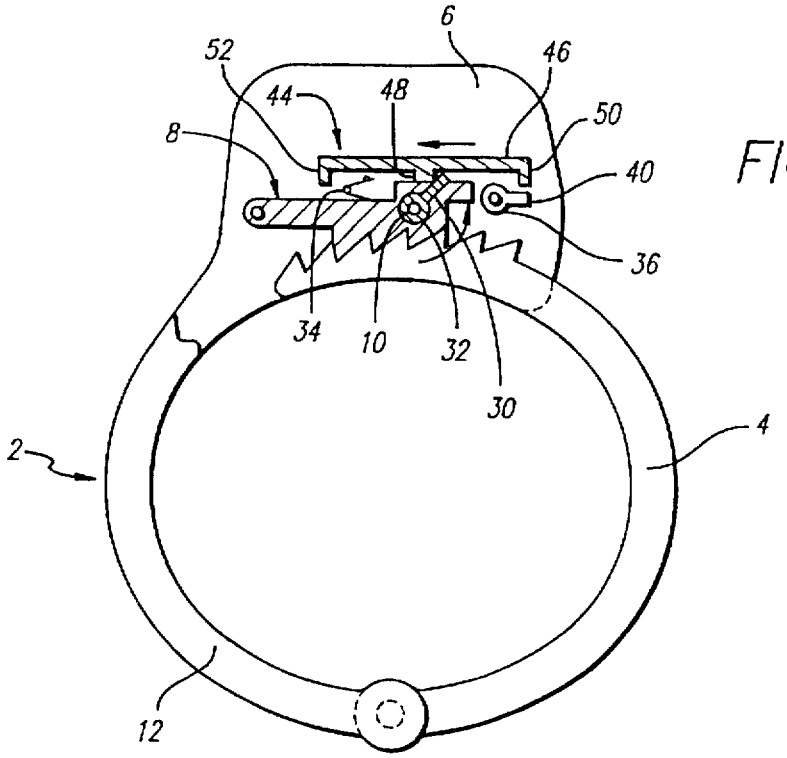
FIG. 3(A) is a side view of an alternate embodiment of the handcuff showing the ratchet member being engaged by the pawl and the double locking mechanism situated in the engaged position, with the quick-release shaft being rotatable about its coupling to the pawl to disengage the double locking mechanism.
Figure 3B:
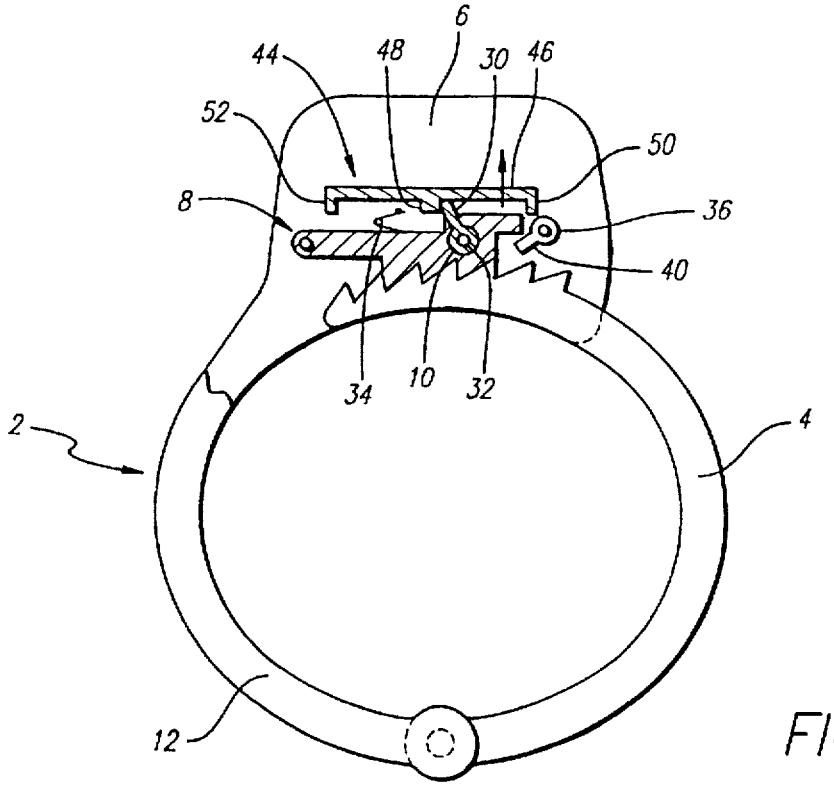
FIG. 3(B) is a side view of the alternate embodiment of the handcuff shown in FIG. 3(A), with the ratchet member being engaged by the pawl and the double locking mechanism being disengaged by rotation of the quick-release shaft.
Figure 3C:
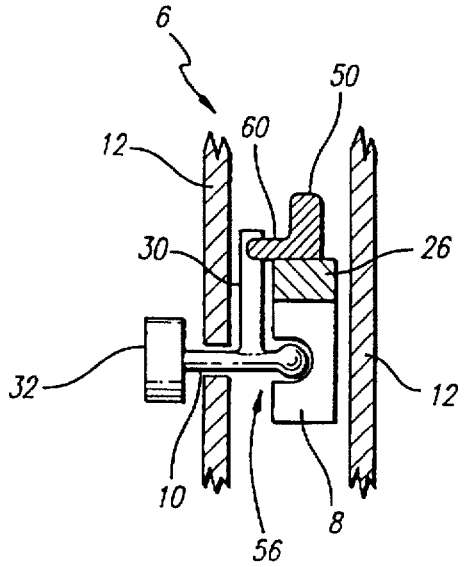
FIG. 3(C) is a partial end view of the locking assembly in accordance with the alternate embodiment shown in FIG. 3(A) wherein the quick-release shaft is pivotally coupled to the pawl via a detachable ball and socket joint.
Figure 3D:
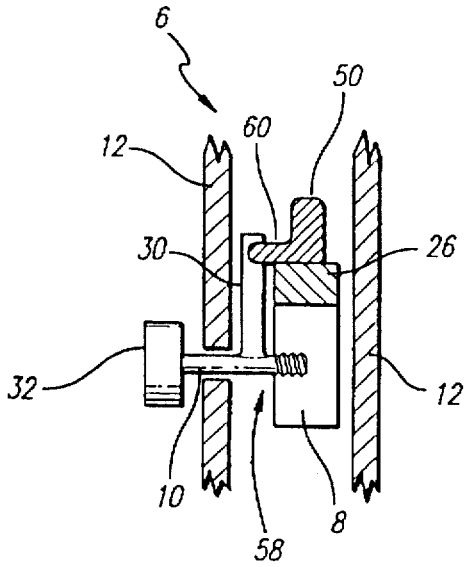
FIG. 3(D) is a partial end view of the locking assembly in accordance with the alternate embodiment shown in FIG. 3(A) wherein the quick-release shaft is pivotally coupled to the pawl via mutual threading between the end of the shaft and a socket formed in the pawl.
Figure 4A:
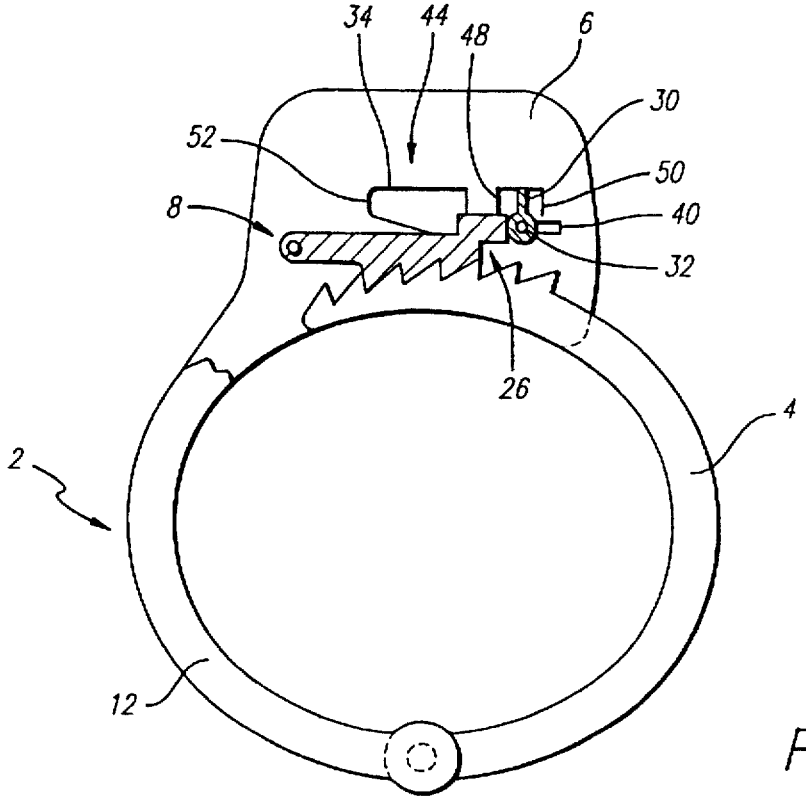
FIG. 4(A) is a side view of an alternate embodiment of the handcuff showing the ratchet member being engaged by the pawl and the double locking mechanism situated in the engaged position, with the quick-release shaft pivotally coupled to a side plate of the bail proximate to the second end of the pawl to enable disengagement of the double locking mechanism and unlocking of the handcuff with a single rotational movement of the shaft.
Figure 4B:
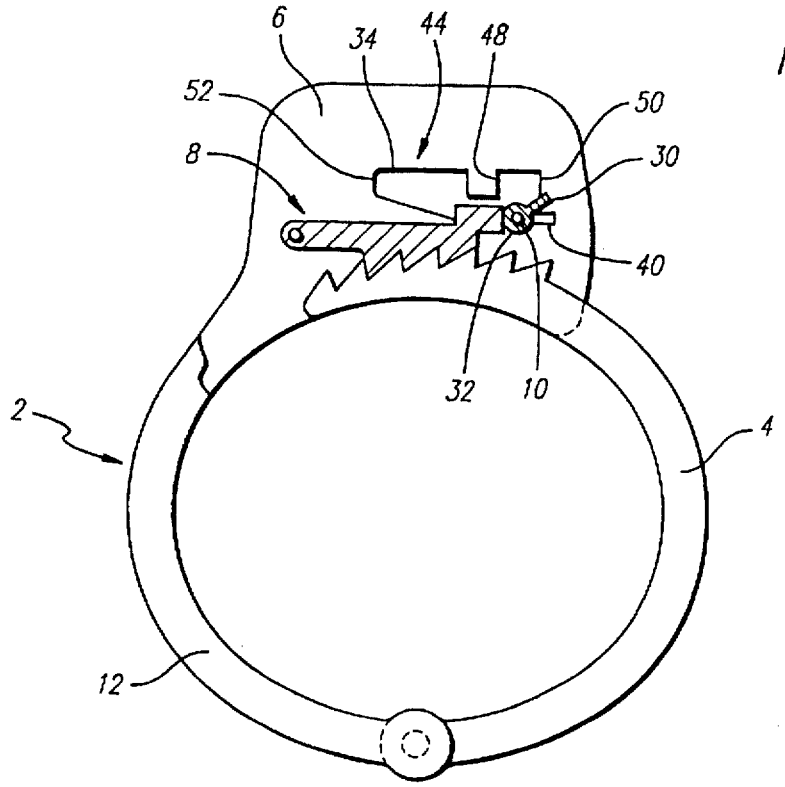
FIG. 4(B) is a side view of the alternate embodiment of the handcuff shown in FIG. 4(A), with the ratchet member being engaged by the pawl and the double locking mechanism situated in the disengaged position.
Figure 4C:
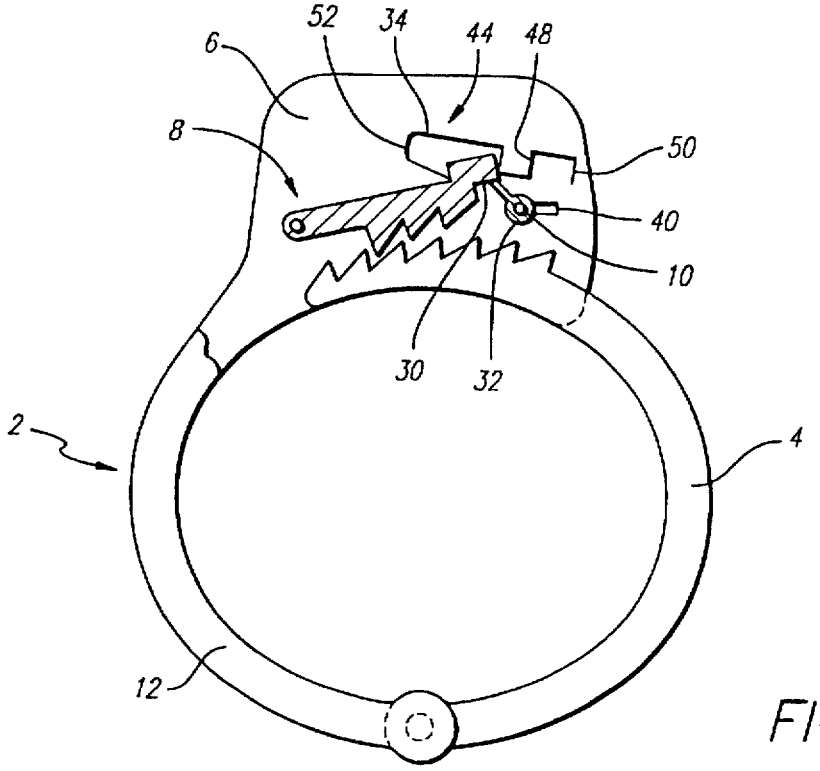
FIG. 4(C) is a side view of the alternate embodiment of the handcuff shown in FIG. 4(A), with the ratchet member being disengaged from the pawl and the double locking mechanism also situated in the disengaged position.

According to an alternate embodiment shown in FIGS. 3(A) and 3(B), the handcuff of the present invention is provided with a quick-release shaft 10 pivotally coupled to the pawl 8 at its second end 24. The rotatable shaft 10 comprises a lateral flange or projection 30 disposed proximate to its coupling to the pawl 8 for engagement with a lateral protuberance 60 formed on the shoulder portion 48 of the stop member 44. In this manner, the double locking mechanism can be disengaged without the need for a key 36 by rotating the knob 32 of the shaft 10 in a counter-clockwise direction to engage the lateral projection 30 with the lateral protuberance 60 and moving the shoulder portion 48 out of contact with the pawl 8. Then to unlock the handcuff, the user need only raise the knob 32 of the quick-release shaft 10 upwards to disengage the pawl 8 from the ratchet member 4.

Furthermore, the dual functionality of the handcuff is retained in this embodiment by providing a release mechanism which disconnects the quick-release shaft 10 from its rotational coupling to the pawl 8 such that the knob 32, shaft 10 and lateral projection 30 of the shaft 10 can be removed from the handcuff when it is desired to convert the handcuffs for actual use. The release mechanism may comprise a detachable (and flexible) ball and socket joint 56 with the ball being affixed to the end of the shaft 10 and the socket being formed in the side face of the pawl 8 (FIG. 3(C)) to enable rotation of the shaft 10 upon insertion of its end into the socket. Alternatively, the release mechanism may comprise the provision of threads 58 on the end of the shaft 10 and a threaded socket formed in the side face of the pawl 8 (FIG. 3(D)) such that a counter-clockwise rotation of the shaft 10 acts to disengage the double locking mechanism while a clockwise rotation of the shaft 10 (when the shoulder portion 48 is moved out of contact with the pawl 8) acts to unscrew the shaft 10 from the pawl 8. Furthermore, the quick-release shaft 10 may be made detachable by inserting it completely through the pawl 8 and both side plates 12 of the bail 2 and securing it in place by attaching a knob 32 to each end of the shaft 10 via threads or ball and socket joints. With this construction, the shaft 10 is removed by detaching one of the knobs 32 and pulling the shaft 10 out of the insertion hole. To perfect this embodiment for actual use, it is preferable to provide the slot formed in the side plate 12 of the bail 2, and hence the coupling of the shaft 10 to the pawl 8, as far to the left of the shoulder portion 48 of the stop member 44 as possible (when in contact with the pawl 8) to prevent a suspect from disengaging the double locking mechanism by moving the shoulder portion 48 to the left with an instrument.

In an embodiment of the present invention that does not include a stop member 44, the shaft 10, instead of extending perpendicular to the plane of the handcuff, may be in the plane of the handcuff. For example, the shaft 10 that is coupled to the pawl 8 may extend vertically upwards from the pawl 8 and extend from the top of the second end of the bill portion. In this embodiment, one can release the handcuff (i.e., cause the pawl 8 to disengage from the ratchet member 4) by pulling the shaft 10 in a generally upwards direction. The connection of the shaft to the pawl may be through a ball and socket joint or through the provision threads (e.g., an eye-screw), as described previously with respect to FIG. 3C and 3D.

Furthermore, in an embodiment with a stop member 44, which acts to maintain the engagement between the pawl 8 and ratchet member 4 despite movement of the quick-release shaft 10 or rotation of a key 36, a shaft may be coupled to the stop member 44 to engage and disengage the stop member 44. The shaft may be coupled to the stop member 44 through a top portion of the second end of the bail (i.e., along a imaginary vertical line drawn through the second end of the bail). This coupling may be made via threads or a ball and socket joint. A user of the handcuff may engage the stop member 44 by moving the shaft in a generally downward vertical direction, and disengage the stop member 44 by moving the shaft in a generally upward vertical direction. To convert the training handcuff into an actual restraint device, this shaft, which is detachably coupled to the stop member 44, which in this embodiment is a bar, is removed so that a suspect cannot disengage the stop member 44 without a key.

In accordance with another alternate embodiment of the present invention shown in FIGS. 4(A), 4(B) and 4(C), the quick-release shaft 10 is rotatably coupled to either a side plate 12 of the bail 2 or to a stationary member (not shown) within the locking assembly 6 instead of being coupled to the pawl itself. The shaft 10 again comprises a lateral projection 30 proximate to the coupling adapted to engage both the first flange 50 of the stop member 44 and the vertical shoulder 26 of the pawl 8 in order that the double locking mechanism can be disengaged and the handcuff unlocked by means of a single rotation of the shaft 10 in a clockwise direction. To accomplish this, the lateral projection 30 extends to a position between the shoulder portion 48 and the first flange 50 of the stop member 44 (when the shoulder portion 48 is in contact with the pawl 8) so that upon a clockwise rotation, the lateral projection 30 moves the shoulder portion 48 (to the right) off of the upper surface of the pawl 8 and further lifts the vertical shoulder 26 of the pawl 8 upwards. In this embodiment, the shaft 10 is coupled to the bail 2 or stationary member such that it is concentric with the keyhole 42 formed on an opposite side of the bail 2. In this manner, both the lateral extension of the shaft 10 and the flange 40 of the key 36 do not make contact but are positioned for engagement with the first flange 50 of the stop member 44 and the vertical shoulder 26 of the pawl 8. Additionally, the coupling of the shaft 10 to the pawl 8 in this embodiment may further be adapted with a release mechanism as described above in order to enable dual use of the handcuff.

Figure 5A:
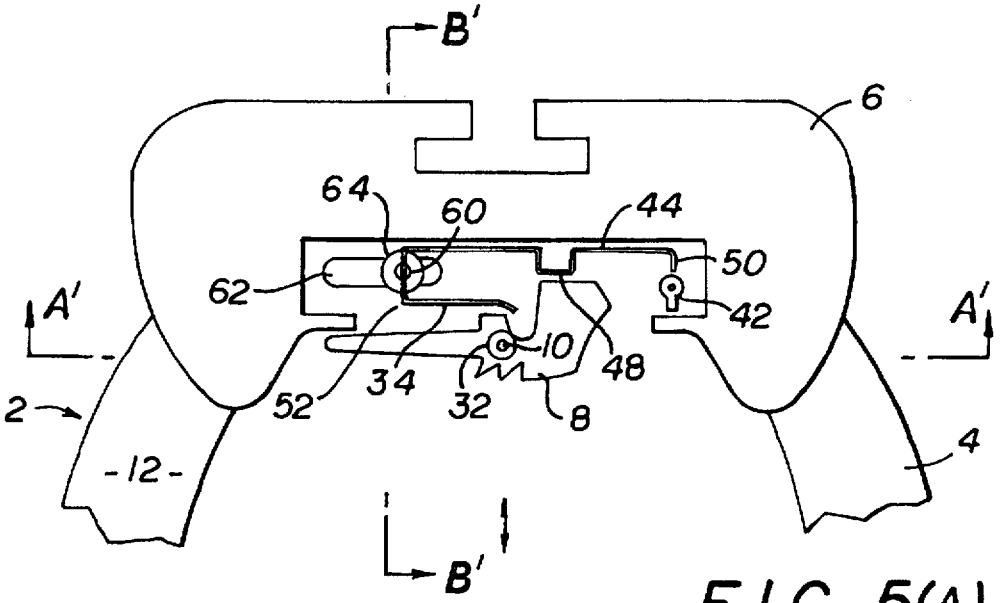
FIG. 5(A) is a side view of another embodiment of the handcuff showing both the quick-release shaft, the double locking shaft and the corresponding knobs at each end.

Referring now to FIG. 5(A), a side view of another embodiment of the present invention is illustrated. Stop member 44 is an elongated strip of metal in this embodiment. The stop member 44 acts as a double locking mechanism that may be brought into a locked position, where the stop member 44 prevents the pawl 8 from being disengaged from the teeth of ratchet member 4 (not shown). When the stop member 44 is in an unlocked position, the pawl 8 may be disengaged from the teeth of ratchet member 4, by means of the quick-release shaft 10 or by a key 36 (not shown). In this particular embodiment, stop member 44 acts both as the double locking mechanism and as a spring that biases the pawl 8 toward the arcuate ratchet member 4. The stop member 44 may include an integral, elongated strip of metal, as illustrated in FIG. 5(A), or may be a solid member as illustrated in FIGS. 2(A)–2(C).

In the case where the stop member 44 is a solid member, spring 34 becomes an individual element, and is no longer integral with stop member 44 (e.g., FIGS. 2(A)–2(C), element 34). The use of a separate spring 34 to bias the pawl 8 against the arcuate member 4 is clearly shown in FIGS. 2(A)–2(C).

FIG. 5(A) also illustrates the quick-release shaft 10 that is connected to a knob 32. As mentioned previously, a translation of the knob 32, connected to the quick-release shaft 10, disengages the pawl 8 from the teeth of arcuate ratchet member 4 (see FIGS. 3(C) and 3(D)) when the stop member 44 is in the unlocked position. In this embodiment, the quick-release shaft 10 is coupled directly to pawl 8.

Referring still to the FIG. 5(A), the stop member 44 comprises a downward extending shoulder portion 48, which engages an upper surface of the pawl 8 in the double locked position and is not coupled to the pawl 8 in the unlocked position. The stop member 44 further comprises first and second downward extending flanges 50, 52 disposed on respective ends of the stop member 44, where the first flange 50 is located proximate to the second end 24 of the pawl 8 and flange 40 of a key 36 when inserted, and the second flange 52 is located proximate to a horizontal slot 62. As mentioned previously, the stop member 44 is movable in a generally horizontal direction by application of a force to second flange 52 to move shoulder portion 48 in and out of contact with the upper surface of the pawl 8. When in contact with the pawl, the stop member 44 acts to maintain the engagement between the pawl 8 and ratchet member 4 (not shown), despite movement of a quick-release shaft 10 or rotation of a key 36.

In this embodiment, the double locking mechanism is engaged by moving the stop member 44 by a second shaft 60, coupled to the second flange 52 of the stop member 44. By moving the second shaft 60 in a generally horizontal direction, the stop member 44 that is detachably coupled to the second shaft 60 at second flange 52, engages the pawl 8. This double locking mechanism may also be engaged by inserting and moving the butt 38 of the key 36 through the horizontal slot 62, which is formed in the side plate 12 of the bail 2, into contact with the second flange 52 of the stop member 44.

The second shaft 60 extends through the horizontal slot 62 formed in a side plate 12 of the bail 2. Furthermore, this second shaft 60 passes through both side plates 12 of bail 2, and engages the second flange 52 of stop member 44. The second shaft 60 is secured in place by attaching a first knob 64 to one end of the second shaft 60 and a second knob 65 to the other end of the second shaft 60. The first and second knobs 64, 65 may be attached to the second shaft 60 in a number of ways (e.g., via threads or a ball and socket joint). With this construction, the second shaft 60 is removed by detaching one of the knobs 64, 65 and pulling the second shaft 60 out of the horizontal slot 62.

Figure 5B:
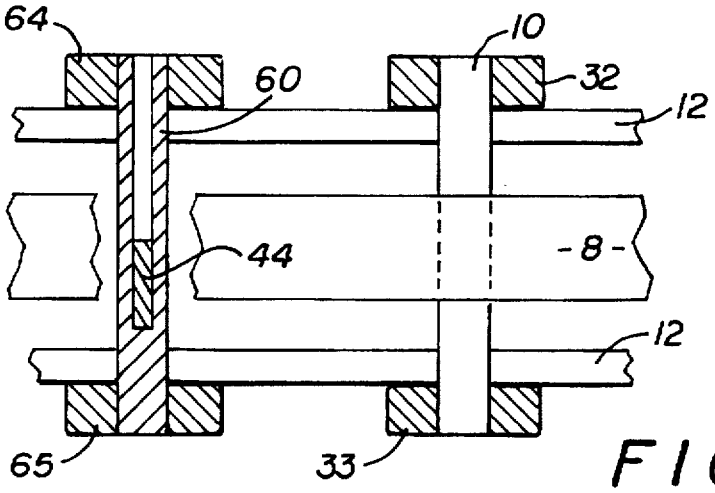
FIG. 5(B) illustrates a sectional view of the handcuff through line A'—A'.

FIG. 5(B) illustrates a sectional view of the handcuff through line A'—A'. FIG. 5(B) illustrates the first shaft 10 having a first knob 32 disposed at one end and a second knob 33 disposed at an opposite end. The first shaft 10 passes through the pawl 8 and the two side plates 12. FIG. 5(B) also illustrates a second shaft 60 (e.g., a split shaft) having a first knob 64, disposed at one end, and a second knob 65 disposed at an opposite end. When the second shaft 60 is a split shaft, the second shaft 60 engages both sides of the second flange 52 of the stop member 44 as shown.

Figure 5C:
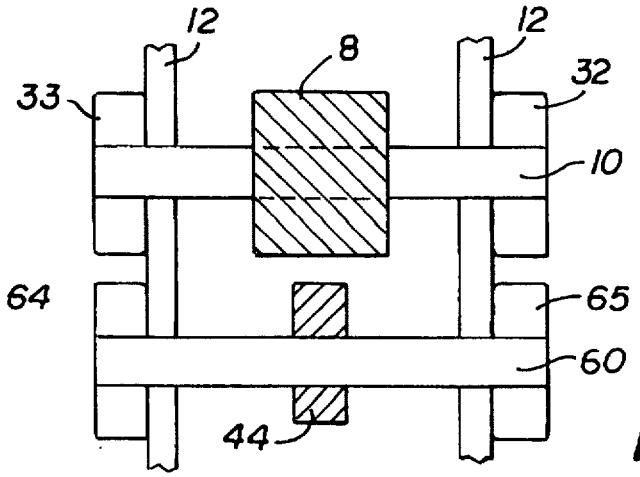
FIG. 5(C) illustrates a sectional view of the handcuff through line B'—B'.

FIG. 5(C) illustrates a sectional of the handcuff through line B'—B'.

FIG. 5(C) illustrates the first shaft 10 having a first knob 32 at one end and a second knob 33 at an opposite end. Shaft 10 passes through a pawl piece 8 and also passes through side plates 12. A second shaft 60 having a first knob 64 and a second knob 65 at opposite ends is also shown. The second shaft 60 passes through the side plates 12 and engages the stop member 44.

It is noted that although the present invention has been described in terms of the preferred and alternate embodiments, it will be appreciated that various modifications and alterations might be made to improve the operation of the handcuff by those skilled in the art without departing from the spirit and scope of the invention. Therefore, the invention should be measured in terms of the claims which follow.

We claim:

1. A handcuff for dual use as a quick-release training device and an actual restraint device, the handcuff comprising:

a bail having parallel side plates extending between first and second ends of the bail, the bail comprising an arcuate ratchet member having a proximate end pivotally coupled to the first end of the bail and a distal end with teeth adapted for passage through the side plates of the bail upon pivotal movement of the ratchet member;

a locking assembly disposed within the side plates at the second end of the bail and comprising a pawl having a first end pivotally coupled to the bail and a second end adapted with teeth, the second end of the pawl pivotal between a secured position in which the teeth of the pawl engage the teeth of the ratchet member and an unsecured position in which the second end of the pawl is separated from the ratchet member, the second end of the pawl further having a vertical shoulder for engagement with the flange of a key inserted within the locking assembly for manipulating the pawl between the secured and unsecured positions upon rotation of the key;

a stop member disposed above the pawl movable in and out of contact with the pawl upon engagement with the key to prevent the pawl from being placed in the unsecured position when the stop member is in contact with the pawl, the stop member being movable rotating the key within the assembly to contact the stop member with the flange of the key, the stop member including a spring portion for biasing the second end of the pawl toward the secured position;

a first shaft coupled to the pawl and protruding from the second end of the bail for placing the pawl in the unsecured position upon translation of the first shaft in a direction generally away from the ratchet member; and a second shaft coupled to the stop member and protruding from the second end of the bail for placing the stop member in and out of contact with the pawl;

whereby when the handcuff is locked by insertion of the ratchet member within the bail and the stop member is not in contact with the pawl the handcuff is easily unlocked during training by movement of the first shaft away from the ratchet member, and when the handcuff is locked by insertion of the ratchet member within the bail and the stop member is in contact with the pawl the handcuff cannot be unlocked by movement of the first shaft away from the ratchet member, and whereby the stop member is placed in and out of contact with the pawl by movement of the second shaft in a generally horizontal direction.

2. The handcuff of claim 1, wherein the first shaft is detachably coupled to the pawl, enabling detachment of the first shaft from the pawl to convert the hand handcuff to an actual restraint device requiring use of the key to unlock the handcuff when the shaft is detached from the handcuff;

wherein the second shaft is detachably coupled to the stop member, enabling detachment of the second shaft from the stop member, to convert the handcuff to an actual restraint device requiring use of the key to move the stop member in and out of contact with the pawl.

3. The handcuff of claim 2, wherein the pivotal coupling between the shaft and the pawl comprises of a coupling selected from the group consisting of a first coupling comprising a detachable ball and socket joint, a second coupling comprising mutual threading between the proximate end of the shaft and a socket formed in the pawl, and a third coupling comprising a bore formed through and substantially perpendicular to both the pawl and the side plates of the bail for passage of the shaft therethrough, the shaft having a knob detachably attached to each end of the shaft for securing the shaft to the handcuff.

4. The handcuff of claim 2, wherein a keyhole is formed in a side plate of the bail proximate to the second end of the bail for insertion of the key into the locking assembly and placement of the flange of the key proximate to the second end of the pawl.

5. The handcuff of claim 4, wherein the stop member comprises a bar disposed above the pawl having a shoulder portion extending downward towards the second end of the pawl and a first flange extending downward towards the keyhole, the flange of the key engaging and moving the first flange of the bar to move the shoulder portion in and out of contact with the second end of the pawl by rotation of the key.

6. The handcuff of claim 5, wherein the bar comprises a second flange disposed between the first flange and the shoulder portion extending downward towards the second end of the pawl, with the lateral projection of the shaft engaging the second flange up on rotation of the shaft to move the shoulder portion in and out of contact with the second end of the pawl to place the pawl in the secured and unsecured positions, respectively.

7. The handcuff of claim 6, wherein rotation of one of the key and the shaft in a direction from the first flange to the shoulder portion of the bar places the pawl in the unsecured position and rotation of one of the key and the shaft in the opposite direction places the pawl in the secured position.

8. The handcuff of claim 7, wherein the bar forms a portion of the spring used for biasing the second end of the pawl towards the secured position.

9. The handcuff of claim 1, wherein the first shaft extends from its coupling to the pawl in a generally perpendicular direction to the side plates of the bail with a first end of the first shaft protruding through a first slot formed in one of the side plates, the first protruded end of the first shaft having a first knob attached thereto;

wherein the second shaft extends from its coupling to the stop member in a generally perpendicular direction to the side plates of the bail with a first end of the second shaft protruding through a first horizontal slot formed in one of the side plates, the first protruded end of the second shaft having a second knob attached thereto.

10. The handcuff of claim 9, wherein a second end of the first shaft protrudes through a second slot in an opposite side plate, the second protruded end of the first shaft having a third knob attached thereto;

wherein a second end of the second shaft protrudes through a second horizontal slot in an opposite side plate, the second protruded end of the second shaft having a fourth knob attached thereto.

11. A quick-release handcuff for use in training, the handcuff comprising:

a bail having parallel side plates extending between first and second ends of the bail, the bail comprising an arcuate ratchet member having a proximate end pivotally coupled to the first end of the bail and a distal end with teeth adapted for passage through the side plates of the bail upon pivotal movement of the ratchet member;

a locking assembly disposed within the side plates at the second end of the bail and comprising a pawl having a first end pivotally coupled to the bail and a second end adapted with teeth, the second end of the pawl pivotal between a secured position in which the teeth of the pawl engage the teeth of the ratchet member and an unsecured position in which the second end of the pawl is separated from the ratchet member, the second end of the pawl further having a vertical shoulder for engagement with the flange of a key inserted within the locking assembly for manipulating the pawl between the secured and unsecured positions upon rotation of the key, a stop member disposed above the pawl movable in and out of contact with the pawl upon engagement with the key to prevent the pawl from being placed in the unsecured position when the stop member is in contact with the pawl, the stop member being movable rotating the key within the assembly to contact the stop member with the flange of the key, the stop member including a spring portion for biasing the second end of the pawl towards the secured position and, a first shaft being rotatably coupled to the second end of the bail and protruding from one of the side plates, the first shaft having a lateral projection for engaging both the stop member and the vertical shoulder of the pawl to simultaneously move the stop member out of contact with the pawl and place the pawl in the unsecured position upon rotation of the first shaft about a longitudinal axis of the first shaft; and a second shaft coupled to the stop member and protruding from the second end of the bail for placing the stop member in and out of contact with the pawl;

whereby when the handcuff is locked by insertion of the ratchet member within the bail and the stop member is in contact with the pawl the handcuff can be easily unlocked during training by rotation of the shaft in a single direction, and whereby the stop member is placed in and out of contact with the pawl by movement of the second shaft in a generally horizontal direction.

12. The handcuff of claim 11, wherein a keyhole is formed in a side plate of the bail proximate to the second end of the bail for insertion of the key into the locking assembly and placement of the flange of the key proximate to the second end of the pawl.

13. The handcuff of claim 12, wherein the stop member comprises a bar disposed above the pawl having a shoulder portion extending downward towards the second end of the pawl and a first flange extending downward towards the keyhole, the flange of the key engaging the first flange of the bar to move the shoulder portion in and out of contact with the second end of the pawl by rotation of the key.

14. The handcuff of claim 13, wherein the lateral projection of the first shaft is disposed proximate to the second end of the pawl between the shoulder portion and the first flange of the pawl such that rotation of the shaft in a direction from the shoulder portion to the first flange of the pawl moves the shoulder portion out of contact with the pawl and places the pawl in the unsecured position to unlock the handcuff, the flange of the key being disposed on a side of the first flange of the bar opposite the shoulder portion such that rotation of the key in a direction from the first flange to the shoulder portion of the pawl moves the shoulder portion into contact with the pawl to double-lock the handcuff.

15. The handcuff of claim 14, wherein the bar forms a portion of the spring used for biasing the second end of the pawl towards the secured position.

16. The handcuff of claim 11, wherein the first shaft extends from its coupling to the pawl in a generally perpendicular direction to the side plates of the bail with the first shaft protruding through a slot formed in one of the side plates, the protruded end of the first shaft having a knob attached thereto of a diameter larger than the length of the slot; and wherein the second shaft extends from its coupling to the stop member in a generally perpendicular direction to the side plates of the bail with a first end of the second shaft protruding through a first horizontal slot formed in one of the side plates, the first protruded end of the second shaft having a second knob attached thereto.

* * * * *

UNITED STATES PATENT AND TRADEMARK OFFICE

CERTIFICATE OF CORRECTION

PATENT NO. : 5,743,117
DATED : April 28, 1998
INVENTOR(S) : Woo et al.

It is certified that error appears in the above-identified patent and that said Letters Patent is hereby corrected as shown below:

Title page,
Item [21], Appl. No.: delete "510,107" and insert -- 08/510,107 --.

Signed and Sealed this

Thirtieth Day of April, 2002

*Attest:*

*Attesting Officer*

JAMES E. ROGAN
*Director of the United States Patent and Trademark Office*